US010030906B2

(12) United States Patent
Hall et al.

(10) Patent No.: US 10,030,906 B2
(45) Date of Patent: Jul. 24, 2018

(54) REFRIGERATOR

(71) Applicant: Electrolux Home Products, Inc., Charlotte, NC (US)

(72) Inventors: David L. Hall, Piedmont, SC (US); Paul H. Kelly, Anderson, SC (US)

(73) Assignee: Electrolux Home Products, Inc., Charlotte, NC (US)

( * ) Notice: Subject to any disclaimer, the term of this patent is extended or adjusted under 35 U.S.C. 154(b) by 561 days.

(21) Appl. No.: 14/576,093

(22) Filed: Dec. 18, 2014

(65) Prior Publication Data

US 2016/0178273 A1 Jun. 23, 2016

(51) Int. Cl.

| | |
|---|---|
| ***F25D 23/12*** | (2006.01) |
| ***F25D 23/02*** | (2006.01) |
| ***F25D 23/04*** | (2006.01) |
| ***F25D 23/06*** | (2006.01) |
| *F25D 23/00* | (2006.01) |

(52) U.S. Cl.

CPC ..... *F25D 23/126* (2013.01); *F25D 23/028* (2013.01); *F25D 23/04* (2013.01); *F25D 23/061* (2013.01); *F25D 23/003* (2013.01); *F25D 2201/12* (2013.01); *F25D 2323/122* (2013.01)

(58) Field of Classification Search

CPC ..... F25D 23/028; F25D 23/126; F25D 23/04; F25D 2323/122; F25D 2201/12; F25D 23/061; F25D 2400/04; B67D 1/0857; E05Y 2900/31

See application file for complete search history.

(56) References Cited

U.S. PATENT DOCUMENTS

| | | | | |
|---|---|---|---|---|
| 3,429,140 A * | 2/1969 | White | F25D 23/126 62/339 |
| 3,834,178 A * | 9/1974 | Pink | F25D 23/126 62/338 |
| 4,912,942 A | 4/1990 | Katterhenry et al. | |
| 6,868,692 B2 * | 3/2005 | Choi | F25D 23/028 222/146.6 |

(Continued)

FOREIGN PATENT DOCUMENTS

EP 2407739 A2 1/2012

OTHER PUBLICATIONS

International Search Report and Written Opinion for PCT/US2015/063141 dated Mar. 11, 2016.

*Primary Examiner* — Frantz Jules
*Assistant Examiner* — Martha Tadesse
(74) *Attorney, Agent, or Firm* — Pearne & Gordon LLP

(57) ABSTRACT

A refrigerator may include a cabinet and a drinkable liquid dispensing system. The cabinet may include chilled cavity, insulation surrounding the chilled cavity, and a door by which the chilled cavity is opened and closed. The chilled cavity may include a reservoir configured to store liquid provided thereto from an external liquid source for chilling in the chilled cavity. The drinkable liquid dispensing system may include dispenser tubing and a liquid dispenser. The dispenser tubing may be configured to transport the chilled liquid from the reservoir to the liquid dispenser. An insulated portion of the dispenser tubing may be positioned between the chilled cavity and the insulation. The liquid dispenser may be positioned within the door and configured to dispense the chilled liquid transported thereto by the dispenser tubing upon request.

6 Claims, 12 Drawing Sheets

(56) References Cited

U.S. PATENT DOCUMENTS

| | | | | |
|---|---|---|---|---|
| 7,188,486 | B2 * | 3/2007 | Olive | B67D 1/0009 62/339 |
| 7,194,872 | B2 | 3/2007 | Kim et al. | |
| 7,228,701 | B2 | 6/2007 | Kim | |
| 7,603,869 | B2 | 10/2009 | Kim et al. | |
| 7,866,165 | B2 | 1/2011 | Jang et al. | |
| 8,281,608 | B2 * | 10/2012 | Kuehl | F16L 9/003 62/259.1 |
| 8,353,177 | B2 * | 1/2013 | Adamski | F25C 5/005 62/344 |
| 9,182,158 | B2 * | 11/2015 | Wu | F25B 1/00 |
| 2004/0182104 | A1 * | 9/2004 | Choi | F25D 23/028 62/389 |
| 2004/0206106 | A1 * | 10/2004 | Lee | F25D 23/126 62/389 |
| 2007/0204647 | A1 * | 9/2007 | Puthiyaveetil | F25D 23/126 62/389 |
| 2008/0196422 | A1 * | 8/2008 | Lee | B67D 1/0857 62/129 |
| 2009/0090123 | A1 | 4/2009 | Son et al. | |
| 2013/0047656 | A1 | 2/2013 | Kang et al. | |

* cited by examiner

REFRIGERATOR

FIELD OF INVENTION

The following description relates generally to a refrigerator.

BACKGROUND OF INVENTION

It is known for a refrigerator to include a water dispenser. It is additionally known for a refrigerator to include a system by which water can be chilled within a chilled cavity of the refrigerator and transported through ambient conditions to a water dispenser positioned within a door of the refrigerator or inside the chilled cavity of the refrigerator.

SUMMARY

The present invention provides a refrigerator.

In one general aspect, the refrigerator, according to the present invention, may include a cabinet and a drinkable liquid dispensing system. The cabinet may include chilled cavity, insulation surrounding the chilled cavity, and a door by which the chilled cavity is opened and closed. The chilled cavity may include a reservoir configured to store liquid provided thereto from an external liquid source for chilling in the chilled cavity. The drinkable liquid dispensing system may include dispenser tubing and a liquid dispenser. The dispenser tubing may be configured to transport the chilled liquid from the reservoir to the liquid dispenser. An insulated portion of the dispenser tubing may be positioned between the chilled cavity and the insulation. The liquid dispenser may be positioned within the door and configured to dispense the chilled liquid transported thereto by the dispenser tubing upon request.

The insulated portion of the dispenser tubing may be positioned tangent to the chilled cavity. The insulated portion of the dispenser tubing may be positioned between a bottom wall of the chilled cavity and the insulation. The insulated portion of the dispenser tubing may be secured to the chilled cavity by the insulation.

The chilled cavity may further include a dispenser tubing hole at a rear bottom wall of the chilled cavity from which the insulated portion of the dispenser tubing extends. The reservoir may include an outlet configured to provide the chilled liquid to a chilled portion of the dispenser tubing positioned in the chilled cavity and connected to the insulated portion of the dispenser tubing through the dispenser tubing hole. The cabinet may further include a machine compartment positioned underneath the insulation.

The insulated portion of the dispenser tubing may extend from the dispenser tubing hole to a location at which the insulation interfaces with the front area of the machine compartment. When the insulated portion of the dispenser tubing is at a location between the insulation and the chilled cavity at which the insulated portion of the dispenser tubing is separated from the front area of the machine compartment by the insulation, the insulated portion of the dispenser tubing may run through the hole in the insulation to the insulation interface location. The cabinet may further include a freezer cavity positioned adjacent to the chilled cavity and insulated from the chilled cavity by a mullion filled with the insulation. The insulation interface location may be substantially adjacent to the mullion.

An ambient portion of the dispenser tubing may meet the insulated portion of the dispenser tubing at the insulation interface location. The ambient portion of the dispenser tubing may be positioned within the front area of the machine compartment. A liquid valve may be positioned in the ambient portion of the dispenser tubing.

The cabinet may further include a freezer cavity and a freezer door including the liquid dispenser. The freezer cavity may be positioned adjacent to the chilled cavity and insulated from the chilled cavity. The freezer door may be configured to close the freezer cavity. The ambient portion of the dispenser tubing may extend from the insulation interface location to a location at which a hole in a hinge of the freezer door interfaces with the front area of the machine compartment. The door portion of the dispenser tubing may extend from the freezer door interface location through the freezer door to the liquid dispenser.

In one example of the first aspect, the chilled cavity may further include a tubing hole in a rear wall thereof from which the insulated portion of the dispenser tubing extends. The reservoir may include an outlet configured to provide the chilled liquid to a chilled portion of the dispenser tubing positioned in the chilled cavity and connected to the insulated portion of the dispenser tubing through the tubing hole.

The insulated portion of the dispenser tubing may include a first insulated section and a second insulated section. The first insulated section may be positioned between a rear wall of the chilled cavity and the insulation. The second insulated section may be positioned substantially between a top wall of the chilled cavity and the insulation. An ambient portion of the dispenser tubing may include a first ambient section and a second ambient section. The first ambient section may extend between the first insulated section and the second insulated section. The second ambient section may extend from the second insulation section. The first insulated section may extend upward from the tube hole between the rear wall of the chilled cavity and the insulation and exit the insulation to meet the first ambient section between the insulation and a rear wall of the cabinet. The first ambient section may extend upward from the first insulated section between the insulation and the rear wall of the cabinet and meet the second insulated section at a first location at which the insulation interfaces with an area between a rear wall of the cabinet and the insulation. The second insulated section may extend through a first hole in the insulation to meet with the first ambient section at the first insulation interface location.

The second insulated section may extend through a second hole in the insulation and meet the second ambient section at a second location at which the insulation interfaces with a top wall of the cabinet. The second insulated section may extend through a second hole in the insulation to reach the second insulation interface location. The second ambient section may extend from the second insulated section from the second insulation interface location through the top wall of the cabinet and out of a cabinet-side portion of a hinge for the door. The cabinet-side portion of the hinge may be positioned on the top wall of the cabinet. The second ambient section may extend from the cabinet-side portion of the hinge through a door-side portion of the hinge positioned at a top wall of the door to meet a door portion of the dispenser tubing that extends through the door to the liquid dispenser. A liquid valve may be positioned in the second ambient section of the dispenser tubing.

In another general aspect, the refrigerator, according to the present invention, may include a cabinet and a drinkable liquid dispensing system. The cabinet may include a chilled cavity, insulation surrounding the chilled cavity, and a door by which the chilled cavity is opened and closed. The chilled cavity includes a reservoir configured to store liquid provided thereto from an external liquid source to be chilled by the chilled cavity. The drinkable liquid dispensing system may include dispenser tubing and a liquid dispenser. The dispenser tubing may be configured to transport the chilled liquid from the reservoir to the liquid dispenser. An insulated portion of the dispenser tubing may be positioned within the chilled cavity and extend from an area substantially adjacent to a rear wall of the chilled cavity and a rear bottom wall of the chilled cavity to a front edge of the chilled cavity through a conduit positioned on a bottom wall of the chilled cavity. The liquid dispenser may be configured to dispense the chilled liquid transported thereto by the dispenser tubing upon request.

Other features and aspects may be apparent from the following detailed description, the drawings, and the claims.

Figure 1:
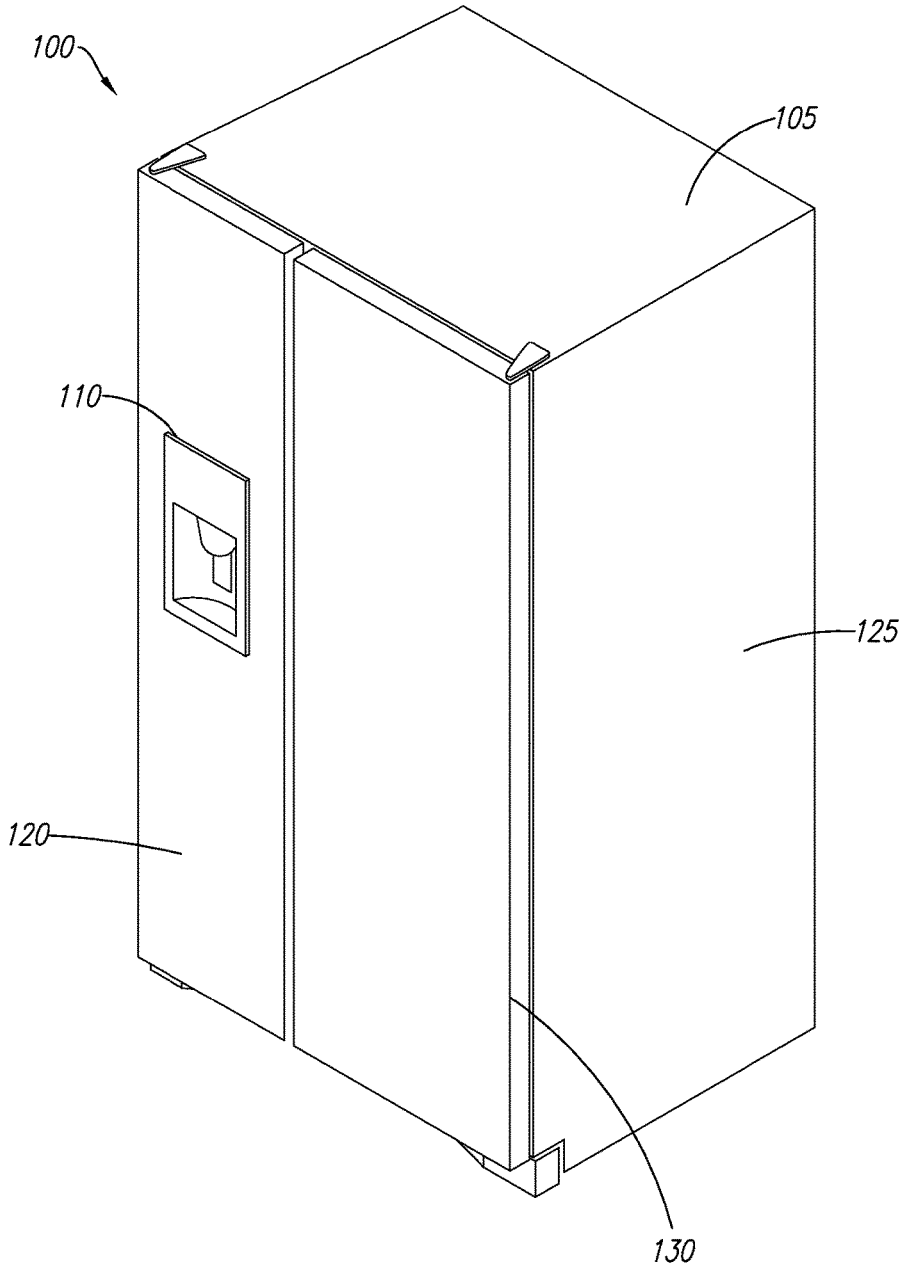
FIG. 1 is a perspective view illustrating an example of a refrigerator.

Throughout the drawings and the detailed description, unless otherwise described, the same drawing reference numerals will be understood to refer to the same elements, features, and structures. The relative size and depiction of these elements may be exaggerated for clarity, illustration, and convenience.

DETAILED DESCRIPTION

One or more examples are described and illustrated in the drawings. These illustrated examples are not intended to be limiting. For example, one or more aspects of an example may be utilized in other examples and even other types of devices.

For purposes herein, the term "liquid" refers to any drinkable liquid known to one of ordinary skill in the art composed of the properties that allow the transporting, chilling, storing, and dispensing thereof within a refrigerator as described herein. The drinkable liquid may be water, which may have the capacity to be frozen into ice by components provided within the refrigerator. However, the drinkable liquid is not limited to being water.

In examples illustrated in FIGS. 1-9, a side-by-side refrigerator 100 includes a cabinet 105. The cabinet 105 may include a chilled cavity 210, a freezer cavity 230 positioned adjacent to and insulated from the chilled cavity 210, insulation 435 surrounding and placed between the chilled cavity 210 and the freezer cavity 230, a chilled door 130 to close the chilled cavity 210, and a freezer door 120 to close the freezer cavity 230.

The cabinet 105 may further include a machine compartment positioned underneath the insulation 435, the freezer cavity 230, and the chilled cavity 210. The machine compartment may be defined by a front area 411 and a rear area 311. The front area 411 of the machine compartment may be positioned substantially adjacent to a frontal area of the cabinet 105 and hid from a frontal view by a grill 180 that covers a bottom cabinet support bracket 770. The front 411 and rear 311 areas of the machine compartment may store components that emit heat, including, but not limited to, motors and condensers.

The chilled cavity 210 is configured to chill items placed therein and may be partially defined by a rear wall 221, a rear bottom wall 214, an outer side wall 224, an inner side wall 220, a top wall 222, and a bottom wall 413. The chilled cavity 210 includes a reservoir 205 configured to store and chill liquid provided to the reservoir 205 from an external liquid source 406.

The reservoir 205 is illustrated in FIGS. 2, 4-6, and 10 as a cuboid enclosure positioned on the rear bottom wall 214 of the chilled cavity 210. The reservoir 205 is illustrated in FIGS. 2, 4-6, and 10 as being positioned on the rear bottom wall 214 of the chilled cavity 210 and adjacent a rear wall 221 and the outer side wall 224 of the chilled cavity 210. However, embodiments disclosed herein are not limited thereto.

For example, the reservoir may be positioned adjacent the inner side wall 220 of the chilled cavity 210, the top wall 222 of the chilled cavity 210, on the rear bottom wall 214 of the chilled cavity 210, on the rear wall 221 of the chilled cavity 210, or any other area that one having ordinary skill in the art would deem to be reasonable. The reservoir 205 may be a cylindrical enclosure. In addition, the reservoir 205 may be a tank having any reasonable shape known to one of ordinary skill in the art. Further, the reservoir 205 may be a tank that is suspended within the chilled cavity 210 without resting on or being affixed to any surface of the chilled cavity 210. Additionally, the reservoir 205 may be composed of a predetermined amount of bundled tubing provided within the chilled cavity 210. The reservoir 205 may be a coiled tube configured to facilitate movement of the liquid stored and chilled therein.

The freezer cavity 230 may be configured to freeze items placed therein. The freezer cavity 230 may be partially defined by an inner side wall 255, at which the freezer cavity 230 may be insulated from the chilled cavity 210 by a mullion 261 filled with the insulation 435. The freezer cavity 230 may include an icemaker 241 mounted therein. The icemaker 241 may be configured to make ice from liquid received from an ambient icemaker line 342 extending from an icemaker valve 340 to the icemaker 241. The ambient icemaker line 342 may extend from the icemaker valve 340 to the icemaker 241 upwards along a rear wall 320 of the cabinet 105. Chilled liquid stored in the reservoir 205 may be provided to the icemaker valve 340 via a chilled icemaker line 341 extending to the icemaker valve 340 from within the chilled cavity 210.

The refrigerator 100 additionally includes a drinkable liquid dispensing system that may be defined by dispenser tubing and a liquid dispenser 110. While the refrigerator 100 is illustrated in FIGS. 1-9 as being a side-by-side refrigerator, embodiments described herein are not limited thereto. For example, the drinkable liquid dispensing system may be applied in top-mount and convertible refrigerators.

Figure 9:
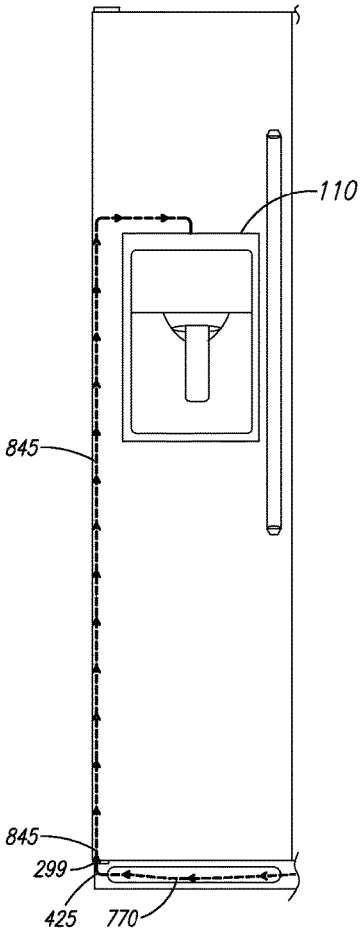
FIG. 9 is a schematic view illustrating an example of the freezer door and the front area of the machine compartment of the refrigerator of FIG. 1.

The dispenser tubing is configured to transport the chilled liquid from the chilled cavity 210 to the liquid dispenser 110, which is configured to dispense the chilled liquid transported thereto upon request from a user. The liquid dispenser 110 is illustrated in FIGS. 1 and 9 as being positioned within the freezer door 120 on an outer surface thereof facing outward from the freezer such that the chilled liquid is transported to the liquid dispenser 110 through the freezer door 120 by the dispenser tubing. However, embodiments described herein are not limited thereto. For example, an ice dispenser may also be mounted within the freezer door 120 along with the liquid dispenser 110. Further, a liquid dispenser may alternatively be mounted within the chilled cavity 210.

The drinkable liquid dispensing system may be additionally defined by a liquid filter 240 positioned within the chilled cavity 210. The liquid filter 240 may be configured to receive liquid provided thereto from the external liquid source 406, filter the liquid provided, and outlet the filtered liquid the reservoir 205 for chilling.

Figure 2:
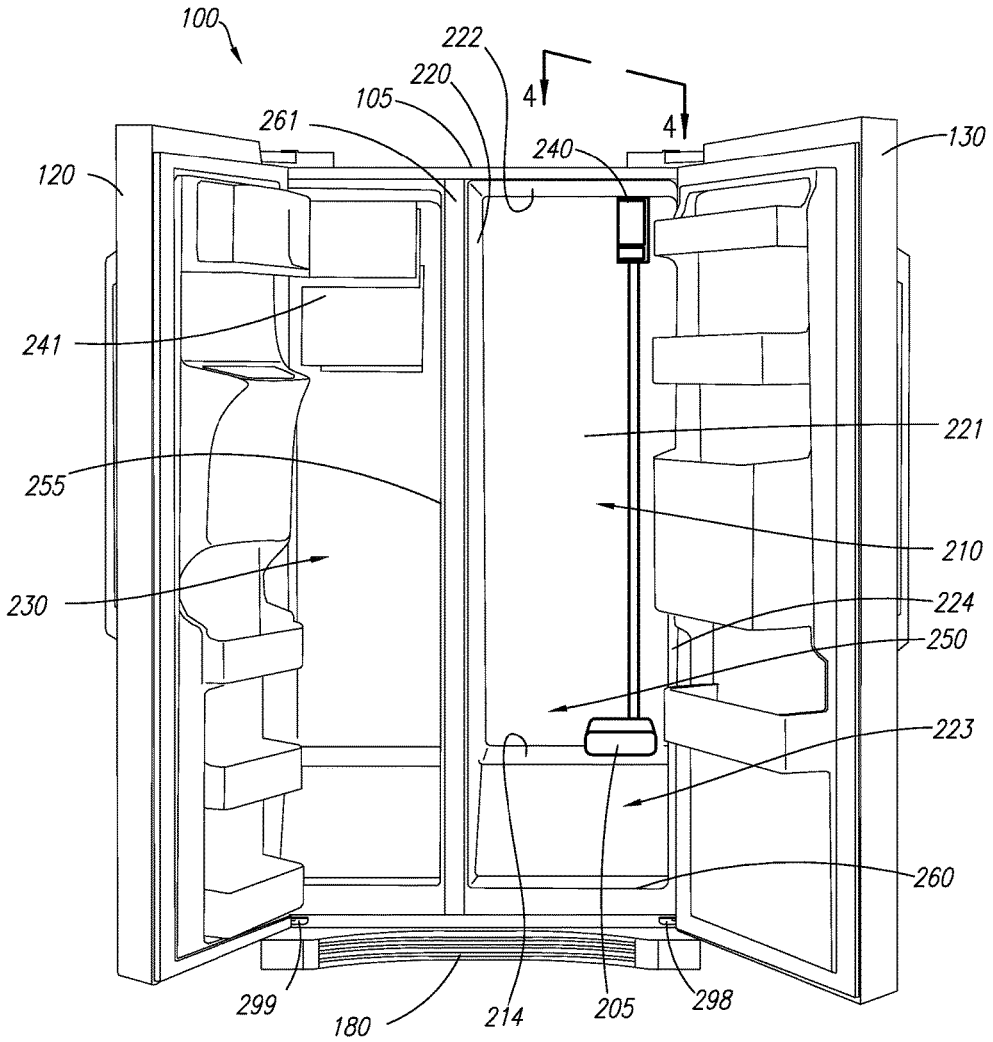
FIG. 2 is a front view illustrating an example of a chilled cavity, a freezer cavity, and respective inner walls of a chilled door and a freezer door of the refrigerator of FIG. 1.
Figure 4:
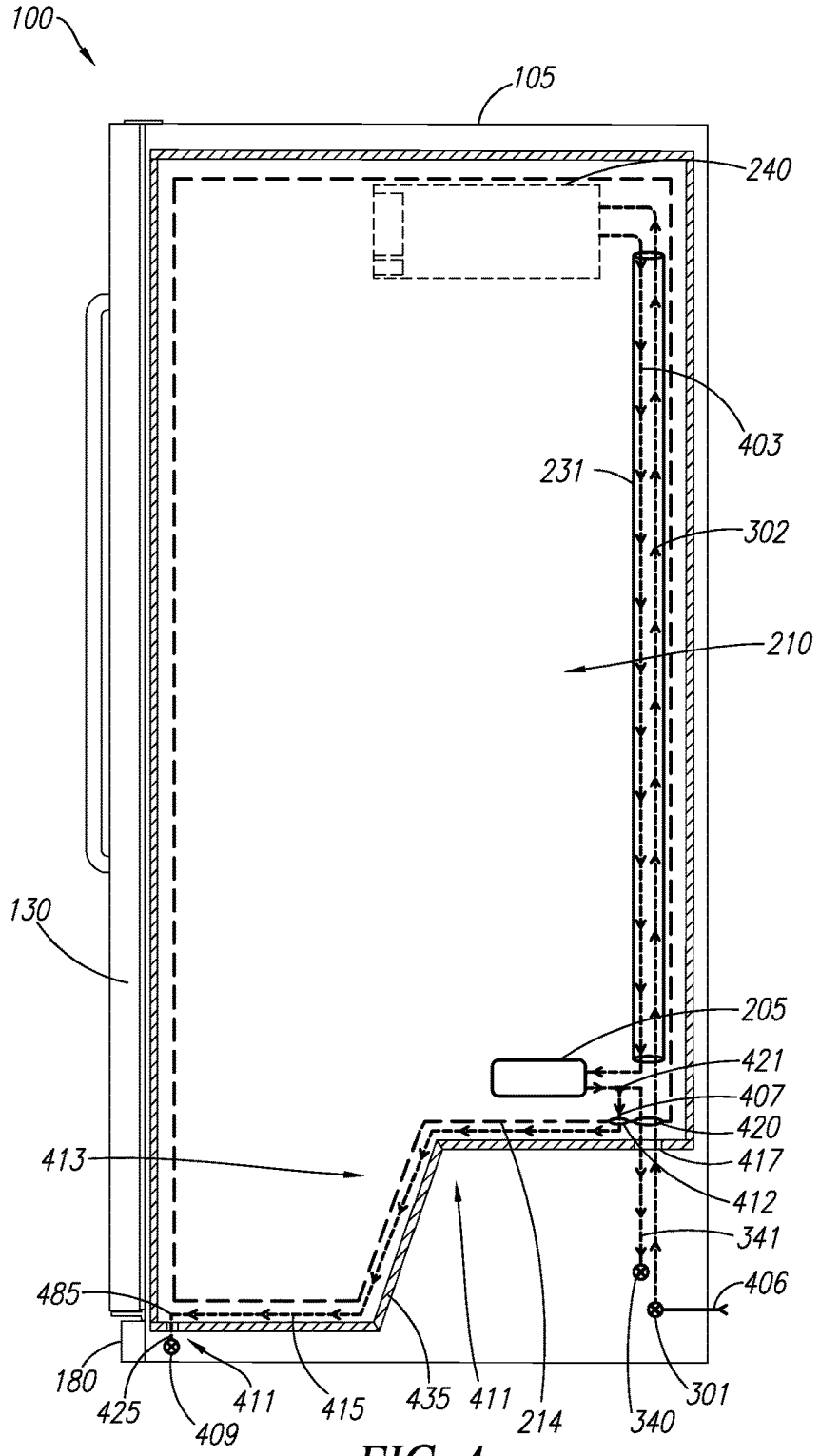
FIG. 4 is a sectional view illustrating an example of the refrigerator taken across 4-4 of FIG. 2.
Figure 5:
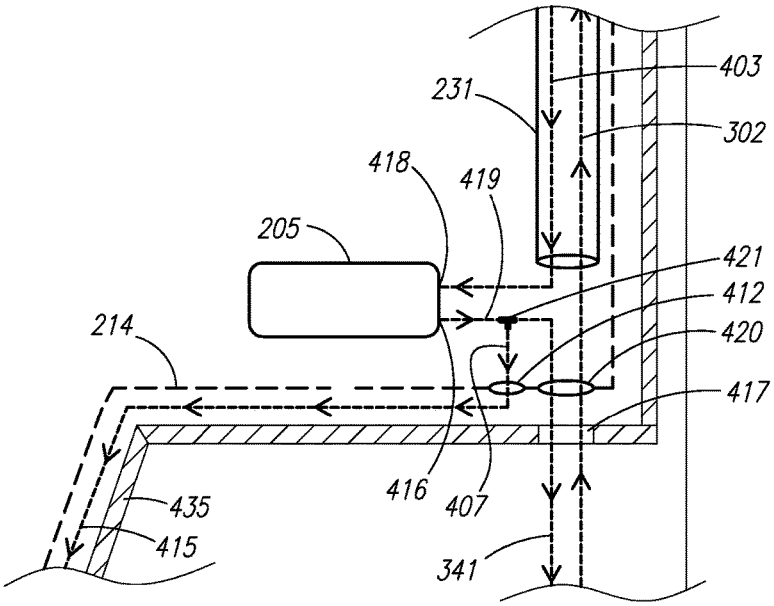
FIG. 5 is a close-up, sectional view illustrating an example of the cabinet and the chilled cavity taken in an area of FIG. 4.

While the liquid filter 240 is illustrated in FIGS. 2 and 4 as being positioned adjacent the top wall 222 and the rear wall 221 of the chilled cavity 210, embodiments disclosed herein are not limited thereto. For example, the liquid filter 240 may be positioned in front of the reservoir 205 at the rear bottom wall 214 of the chilled cavity 210 or at any location within the chilled cavity 210 that would be accommodating with respect to inlet and outlet liquid lines and design of the chilled cavity 210, including, but not limited to, center and bottom portions of the chilled cavity 210. The liquid filter 240 may also be positioned within the front area 411 of the machine compartment underneath the insulation 435 and either the chilled cavity 210 or the freezer cavity 230. For example, a liquid filter may be provided integral to the grill 180 and further recessing into the front area 411 of the machine compartment. In addition, a liquid filter may be provided within an apparatus of the liquid dispenser 110.

The drinkable liquid dispensing system may be further defined by an external liquid inlet valve 301, an external inlet liquid line 302, a filtered liquid line 403, and a liquid dispenser valve 409. The external liquid inlet valve 301 may provide the liquid from the external liquid source 406 to the external inlet liquid line 302.

Figure 3:
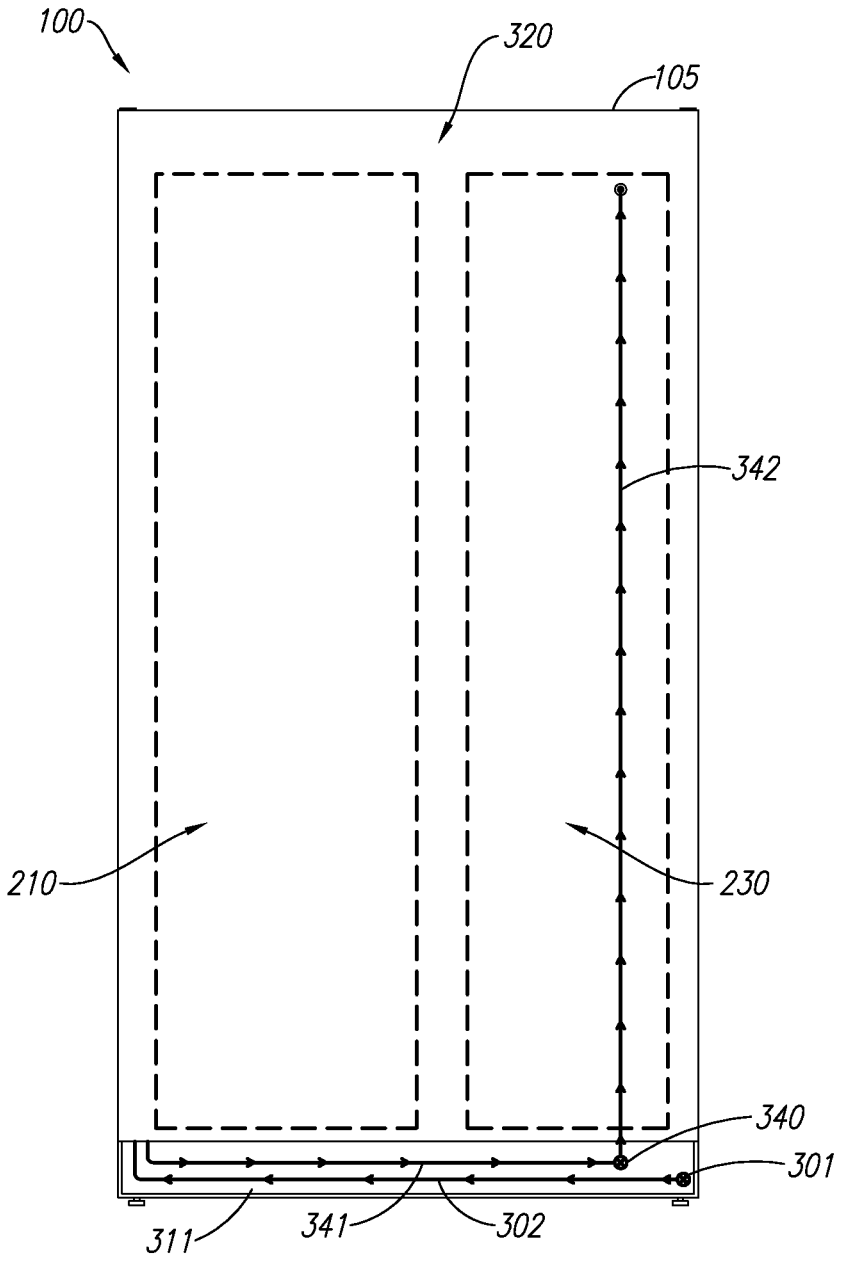
FIG. 3 is a see-through, rear view illustrating an example of the refrigerator of FIG. 1.

As illustrated in FIGS. 3 and 4, the external liquid inlet valve 301 may be provided at a bottom rear portion of the cabinet 105. However, embodiments described herein are not limited thereto. For example, the external liquid inlet valve 301 may be provided in any location at the rear portion of the cabinet 105 that would be seen as accommodating with respect to the receipt of an external supply of liquid to one having ordinary skill in the art.

The external inlet liquid line 302 may transport the external liquid from the external liquid inlet valve 301 to the liquid filter 240. The external inlet liquid line 302 may extend from the external liquid inlet valve 301 through an insulation liquid line hole 417 in the insulation 435 and a sealed cavity liquid line hole 420 in the rear bottom wall 214 of the chilled cavity 210 to enter the chilled cavity 210. The external inlet liquid line 302 may then enter a conduit 231 positioned on the rear wall 221 of the chilled cavity 210 and extend upward to the liquid filter 240 into which the liquid from the external inlet liquid line 302 is provided.

While FIGS. 2, 4-6, and 10 illustrate the external inlet liquid line 302 transporting the liquid upwards to the liquid filter 240, embodiments disclosed herein are not limited thereto. For example, in an instance where the system does not include the liquid filter 240, the external inlet liquid line 302 may transport liquid from the external liquid inlet valve 301 directly to the reservoir 205 for chilling. In another example, an orientation of the external inlet liquid line 302 may be dependent on the positioning of the liquid filter 240 within the chilled cavity 210.

After filtering of the liquid, the liquid filter 240 may outlet the filtered liquid to the filtered liquid line 403. The filtered liquid line 403 may extend from the liquid filter 240 downward through the conduit 231 and into an inlet 418 of the reservoir 205 for chilling the filtered liquid therein until requested by a user. The reservoir 205 may include an outlet 416 from which chilled liquid from the reservoir 205 is transferred into a reservoir outlet line 419 upon user request.

The dispenser tubing may be defined a plurality of portions, including a chilled portion 407, an insulated portion 415, an ambient portion 425, and a door portion 845. The chilled portion 407 of the dispenser tubing may be positioned within the chilled cavity 210. The ambient portion 425 of the dispenser tubing may be positioned within the front area 411 of the machine compartment. The door portion 845 of the dispenser tubing may be positioned within the freezer door 120.

The dispenser tubing may be constructed of any material known to one having ordinary skill in the art to be acceptable for the transport of liquid through various portions of a refrigerated cabinet, such as, but not limited to, polymers and metals. Further, construction material of one portion of the dispenser tubing may be different than construction material of another portion of the dispenser tubing in view of needs identified by one having ordinary skill in the art. For example, a metallic material, such as copper, could be used for one portion of the dispenser tubing, while a polymer material, such as a type of plastic, could be used for another portion of the dispenser tubing.

In addition, one having ordinary skill in the art would realize that the material from which the dispenser tubing is constructed may be adjusted according to the flexibility required of the specific tubing portion. For example, a portion of the dispenser tubing secured within a refrigerator cabinet may be rigid, while a portion of the dispenser tubing provided within a machine compartment located underneath a refrigerator cabinet may be flexible in order to facilitate various connections that are required between rigid portions of the dispenser tubing.

The chilled portion 407 of the dispenser tubing may receive the chilled liquid through a two-way junction 421 that splits the reservoir outlet line 419 into the chilled portion 407 of the dispenser tubing and the chilled icemaker line 341. The chilled portion 407 of the dispenser tubing may extend from the two-way junction 421 to a sealed dispenser tubing hole 412 positioned within the rear bottom wall 214 of the chilled cavity 210. The chilled icemaker line 341 may extend from the two-way junction 421, through the cavity liquid line hole 420, through the insulation liquid line hole 417, and through the rear area 311 of the machine compartment to the icemaker valve 340.

While the chilled icemaker line 341 is illustrated in FIGS. 4-6 and 10 as extending from the two-way junction 421 between the reservoir outlet line 419 and the chilled portion 407 of the dispenser tubing, embodiments disclosed herein are not limited thereto. For example, an alternative to the two-way junction 421 may split the liquid provided by the filtered liquid line 403 between an alternative to the chilled icemaker line 341 and the filtered liquid line 403 leading to the inlet 418 of the reservoir 205. In this example, the liquid being provided to the icemaker 241 would bypass the reservoir 205. In other words, the chilled icemaker line 341 would extend directly from the two-way junction 421 to the icemaker valve 340, thereby bypassing the reservoir 205. Further, in this example, the chilled portion 407 of the dispenser tubing may extend from the reservoir 205 to the dispenser tubing hole 412, and, as such, may take the place of the reservoir outlet line 419.

The insulated portion 415 of the dispenser tubing is positioned between the chilled cavity 210 and the insulation 435 and may extend from the chilled portion 407 of the dispenser tubing at the dispenser tubing hole 412. The insulated portion 415 of the dispenser tubing may additionally extend from the dispenser tubing hole 412 to a location 755 at which the insulation 435 interfaces with the front area 411 of the machine compartment.

The insulated portion 415 of the dispenser tubing may be positioned tangent to the chilled cavity 210 and between the bottom wall 413 of the chilled cavity 210 and the insulation 435. The insulated portion 415 of the dispenser tubing may be secured to the chilled cavity 210 by the insulation 435. The chilled portion 407 of the dispenser tubing may further be connected to the insulated portion 415 of the dispenser tubing through the dispenser tubing hole 412.

When the insulated portion 415 of the dispenser tubing is at a position 485 between the insulation 435 and the chilled cavity 210 at which the insulated portion 415 of the dispenser tubing is separated from the front area 411 of the machine compartment by a hole 765 in the insulation 435, the insulated portion 415 of the dispenser tubing may run through the insulation hole 765 in the insulation 435 to the insulation interface location 755. The insulation interface location 755 may be substantially adjacent to the mullion 261.

An ambient portion 425 of the dispenser tubing may meet the insulated portion 415 of the dispenser tubing at the insulation interface location 755. The ambient portion 425 of the dispenser tubing may be positioned within the front area 411 of the machine compartment. The ambient portion 425 of the dispenser tubing may extend from the insulation interface location 755 to meet the door portion 845 of the dispenser tubing at a location 875 at which a hinge 199 of the freezer door 120 interfaces with the front area 411 of the machine compartment.

The liquid dispenser valve 409 may be configured to control the provision of the chilled liquid to the liquid dispenser 110 from the reservoir 205 according to a request by a user of the refrigerator 100 for chilled liquid. The liquid dispenser valve 409 may be positioned in the ambient portion 425 of the dispenser tubing located in the front area 411 of the machine compartment. However, embodiment disclosed herein are not limited thereto. For example, the liquid dispenser valve 409 may be provided anywhere along a front area 411 of the machine compartment as long it is provided underneath and within a width of the chilled cavity 210.

The door portion 845 of the dispenser tubing may extend upward from the hinge interface location 875 through a hinge hole 895 positioned within the hinge 199. The door portion 845 of the dispenser tubing may continue from the hinge hole 895 through a passageway in the freezer door 120, eventually reaching the liquid dispenser 110 and delivering chilled liquid from the reservoir 205 thereto.

Figure 6:
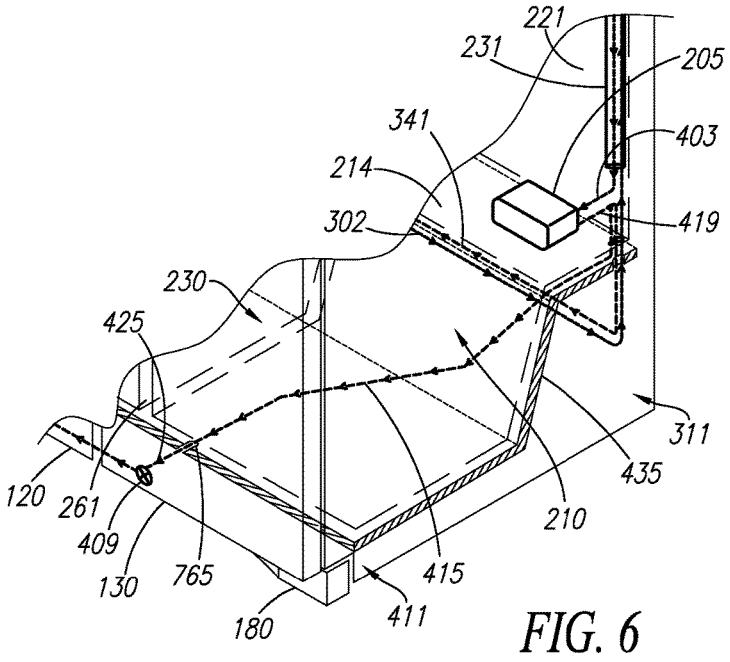
FIG. 6 is a perspective, sectional, schematic view illustrating an example of the cabinet, the chilled cavity, and the chilled door of the refrigerator of FIG. 1.
Figure 7:
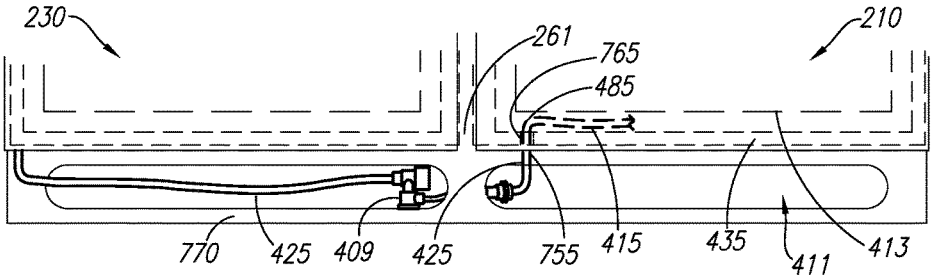
FIG. 7 is a bottom, front view illustrating an example of a front area of a machine compartment of the refrigerator of FIG. 1.
Figure 8:
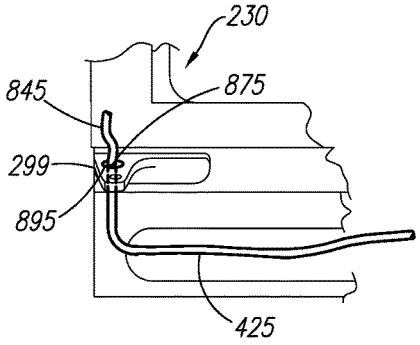
FIG. 8 is a bottom, front view illustrating an example of the front area of the machine compartment of the refrigerator of FIG. 1 on a freezer side with a freezer door being removed.
Figure 10:
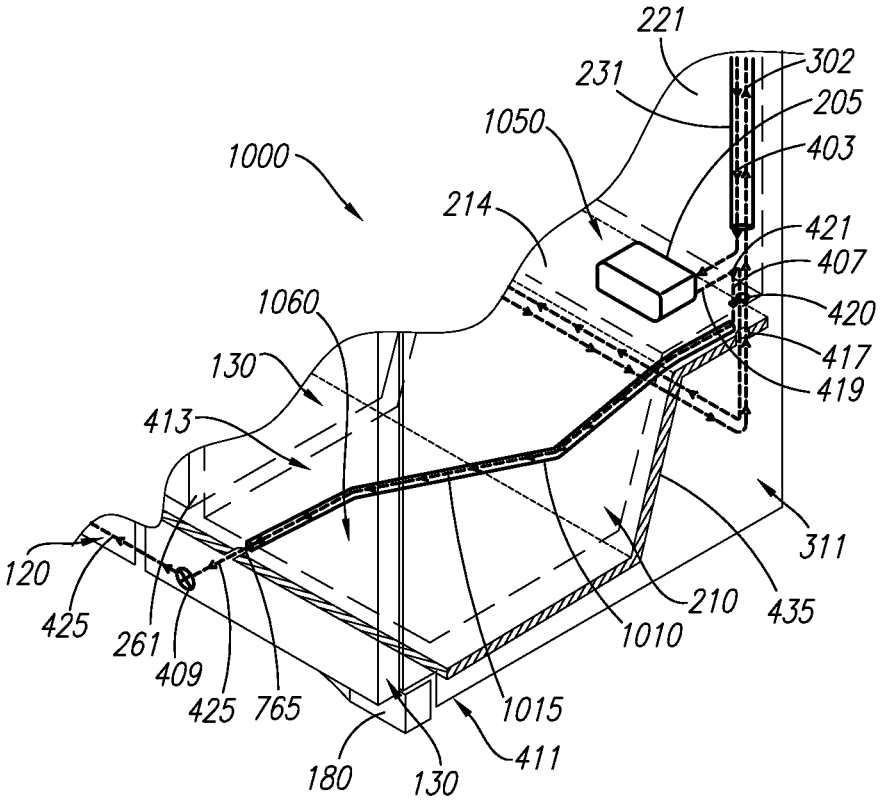
FIG. 10 is a perspective, sectional, schematic view illustrating another example of the cabinet, the chilled cavity, and the chilled door of the refrigerator of FIG. 1.

While FIGS. 6 and 10 illustrate the insulated portion 415 of the dispenser tubing running between the insulation 435 and the chilled cavity 210 such that it makes its way from a location at which the reservoir 205 is disposed to a position substantially adjacent to the mullion 261, embodiments disclosed herein are not limited thereto.

For example, the insulated portion 415 of the dispenser tubing could extend from the dispenser tubing hole 412 between the insulation 435 and the chilled cavity 210 along a path substantially adjacent to a side wall 125 of the cabinet 105 or the outer side wall 224 of the chilled cavity 210. In addition, the insulated portion 415 of the dispenser tubing could meet the ambient portion 425 of the dispenser tubing through a hinge 298 in a way that is similar to the way in which the ambient portion 425 of the dispenser tubing was described to meet the door portion 845 of the dispenser tubing at the hinge interface location 875. Further, the insulated portion 415 of the dispenser tubing may be configured to run anywhere between the chilled cavity 210 and the insulation 435 as long as the insulated portion 415 is sufficiently insulated from the excess cooling provided within the freezer cavity 230.

In another example illustrated in FIG. 10, a refrigerator 1000 may be substantially similar to the refrigerator 100 illustrated in FIGS. 1-9, except that the insulated portion 1015 of the dispenser tubing is positioned within the chilled cavity 210. In this example and in view of the example illustrated in FIG. 2, an insulated portion 1015 of the dispenser tubing extends from an area 1050 substantially adjacent to a rear wall 221 of the chilled cavity 210 and the rear bottom wall 214 of the chilled cavity 210 to a front edge 1060 of the chilled cavity 210 through a conduit 1010 positioned on the bottom wall 413 of the chilled cavity 210.

In additional examples illustrated in FIGS. 11-15, a bottom-mount refrigerator 1100 includes a cabinet 1105. The cabinet 1105 may include a chilled cavity 1240, a freezer cavity 1400 positioned adjacent to and insulated from the chilled cavity 1240, insulation 1311 surrounding and placed between the chilled cavity 1240 and the freezer cavity 1400, a chilled door 1130 to close one side of the chilled cavity 1240, a liquid dispenser door 1125 to close another side of the chilled cavity 1240, and a freezer door 430 to close the freezer cavity 1400. The liquid dispenser door 1125 includes a liquid dispenser 1110 positioned therein facing outward from the chilled cavity 1240.

The refrigerator 1100 additionally may include a machine compartment positioned underneath the insulation 1311 surrounding a bottom of the freezer cavity 1400. The machine compartment may be defined by a front area 1441 and a rear area 1340. The front area 1441 of the machine compartment may be positioned substantially adjacent to a frontal area of the cabinet 1105 and hid from a frontal view by a grill 1190 that covers the front area 1441 of the machine compartment. The front 1441 and rear 1340 areas of the machine compartment may store components that emit heat, including, but not limited to, motors and condensers.

The chilled cavity 1240 is configured to chill items placed therein and may be defined by a rear wall 1271, a top wall 1272, a bottom wall 1273, a right side wall 1274, and a left side wall 1275. The bottom wall 1273 of the chilled cavity 1240 may be provided adjacent to or above a horizontal mullion 1280 filled with insulation 1311. The mullion 1280 may be configured to insulate the chilled cavity 1240 from the freezer cavity 1400. The freezer cavity 1400 may be configured to freeze items placed therein and positioned underneath the mullion 1280 and the chilled cavity 1240.

The chilled cavity 1240 includes a reservoir 1463 configured to chill liquid provided from an external liquid source 1370. The chilled cavity 1240 may additionally include an icemaker 1250 and a liquid filter 1462. The icemaker 1250 may be positioned extending from adjacent the rear wall 1271 and along or adjacent to the right side wall 1274 and the top wall 1272 of the chilled cavity 1240. The liquid filter 1462 may be positioned along or adjacent to the bottom wall 1273 and the right side wall 1274 of the chilled cavity 1240. A reservoir manifold 1260 may be provided to house the liquid filter 1462, the reservoir 1463, and various tubing associated therewith and positioned extending from adjacent the rear wall 1271 of the chilled cavity 1240 and along or adjacent to the bottom wall 1273 and the right side wall 1274 of the chilled cavity 1240.

Figure 12:
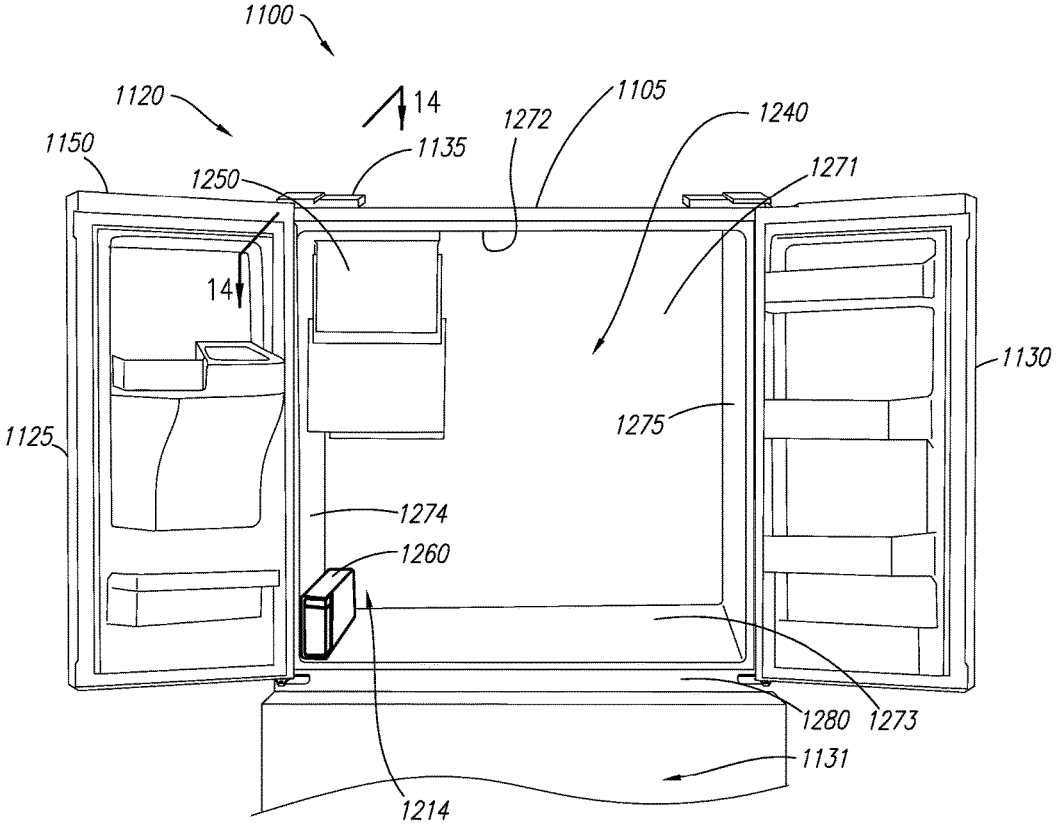
FIG. 12 is a front view illustrating an example of a chilled cavity and inner walls of chilled doors of the refrigerator of FIG. 11.

While the reservoir manifold 1260 is illustrated in FIG. 12 as being positioned extending from adjacent the rear wall 1271 of the chilled cavity 1240 and along or adjacent to the bottom wall 1273 and the right side wall 1274 of the chilled cavity 1240, embodiments disclosed herein are not limited thereto. Further, while the icemaker 1250 is illustrated in FIG. 12 as being positioned extending from adjacent the rear wall 1271 and along or adjacent to the right side wall 1274 and the top wall 1272 of the chilled cavity 1240, embodiments disclosed herein are not limited thereto.

Figure 11:
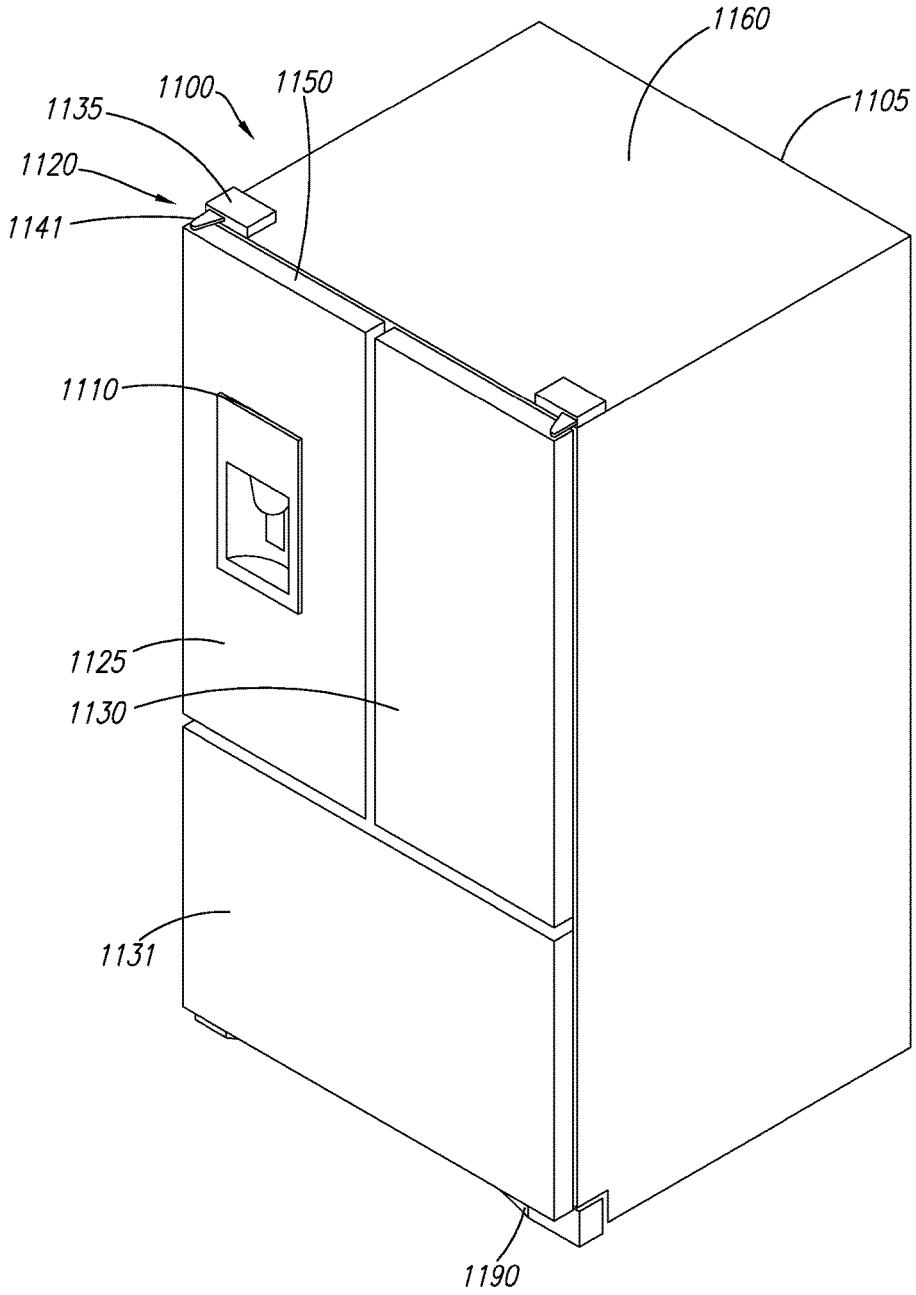
FIG. 11 is a perspective view illustrating another example of a refrigerator.

For example, a position of the reservoir manifold 1260 and the icemaker 1250 may correspond with a position of the liquid dispenser 1110. In other words, while the liquid dispenser door 1125 is illustrated in FIG. 11 as being within the liquid dispenser door 1125 of the chilled cavity 1240, embodiments disclosed herein are not limited thereto. As such, the liquid dispenser 1110 may be positioned within the chilled door 1130 on a left side of the refrigerator 1100. In this case, the reservoir manifold 1260 could be positioned extending from adjacent the rear wall 1271 of the chilled cavity 1240 and along or adjacent to the bottom wall 1273 and the left side wall 1275 of the chilled cavity 1240. Further, the icemaker 1250 may be positioned extending from adjacent the rear wall 1271 and along or adjacent to the left side wall 1275 and the top wall 1272 of the chilled cavity 1240.

In another example, an alternative embodiment of a liquid dispenser 1110 could be positioned within the right side wall 1274 or the left side wall 1275 of the chilled cavity 1240. Moreover, alternative embodiments of the icemaker 1250 could be positioned within the liquid dispenser door 1125, the chilled door 1130, or the freezer cavity 1400. Further, an alternative embodiment of the liquid dispenser 1110 could be a liquid and ice dispenser or other similar variations known to those of ordinary skill in the art.

Figure 14:
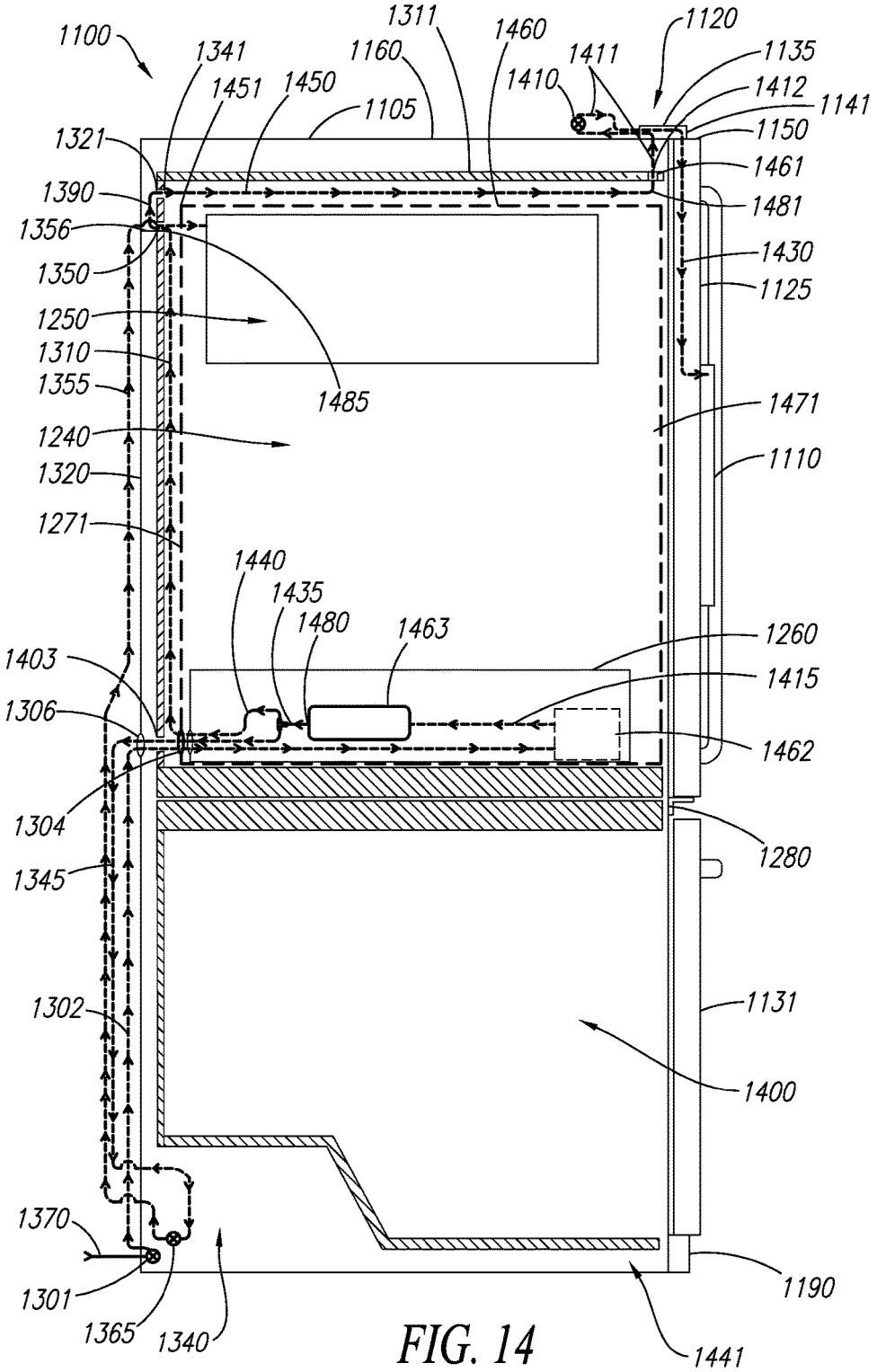
FIG. 14 is a sectional view illustrating an example of the refrigerator taken across 14-14 of FIG. 12.
Figure 15:
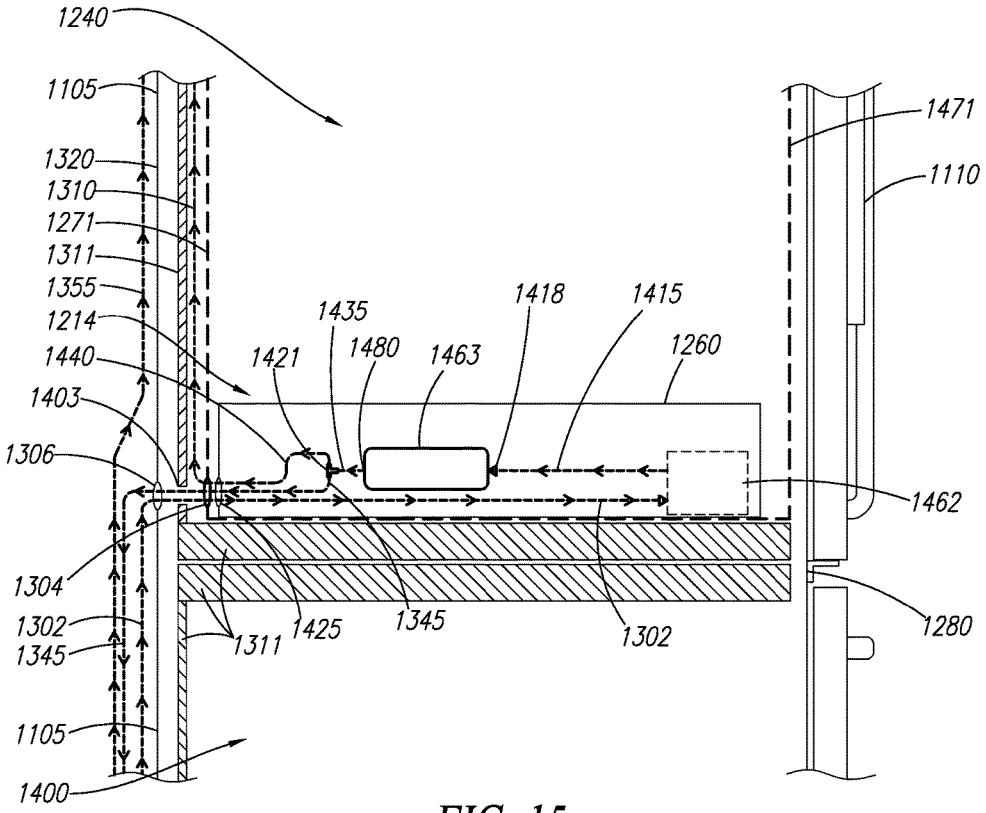
FIG. 15 is a close-up, sectional view illustrating an example of the cabinet and the chilled cavity taken in an area of FIG. 14.

In addition, while the reservoir 1463 and the liquid filter 1462 are illustrated in FIGS. 12, 14, and 15 as being positioned with the reservoir manifold 1260, embodiment disclosed herein are not limited thereto. For example, the reservoir 1463 may be positioned along or adjacent to the bottom wall 1273 and either the right side wall 1274 or the left side wall 1275 of the chilled cavity 1240 while the liquid filter 1462 is positioned along or adjacent to the left side wall 1275 and the top wall 1272 of the chilled cavity 1240 in the same way that the liquid filter 240 is positioned in the refrigerator 100 illustrated in FIGS. 2 and 4. This liquid filter 1462 may be additionally be positioned substantially adjacent to the rear wall 1271 of the chilled cavity 1240.

The reservoir 1463 may be a cylindrical enclosure. In addition, the reservoir 1463 may be a tank having any reasonable shape known to one of ordinary skill in the art. Further, the reservoir 1463 may be a tank that is suspended within the reservoir manifold 1260 without resting on or being affixed to any surface of the reservoir manifold 1260. Additionally, the reservoir 1463 may be composed of a predetermined amount of bundled tubing provided within the reservoir manifold 1260. The reservoir 1463 may be a coiled tube configured to facilitate movement of the liquid stored and chilled therein.

Moreover, the liquid filter 1462 may be provided at the front area 1441 of the machine compartment underneath the freezer cavity 1311 and the corresponding insulation 1311. For example, the liquid filter 1462 may be integrated into the grill 1190 and recessed further into the front area 1441 of the machine compartment. In addition, an alternative embodiment of the liquid filter 1462 may be positioned within the liquid dispenser 1110. Further, embodiments disclosed herein need not include the liquid filter 1462.

The refrigerator 1100 additionally includes a drinkable liquid dispensing system that may be defined by dispenser tubing and the liquid dispenser 1110 positioned within the liquid dispenser door 1125 The dispenser tubing is configured to transport the chilled liquid from the reservoir 1463 to the liquid dispenser 1110. The liquid dispenser 1110 is configured to dispense the chilled liquid transported thereto by the dispenser tubing upon request.

The drinkable liquid dispensing system may also be defined by the reservoir manifold 1260, the liquid filter 1462, a filtered liquid line 1415, a reservoir outlet line 1435, a two-way junction 1421, a chilled icemaker line 1345, an icemaker valve 1365, and an ambient icemaker line 1355. The drinkable liquid dispensing system may further be defined by an external liquid inlet valve 1301, the external liquid source 807 from which the external liquid inlet valve 1301 receives the external liquid, and an external liquid inlet line 1302 receiving the external liquid from the external liquid inlet valve 1301.

Figure 13:
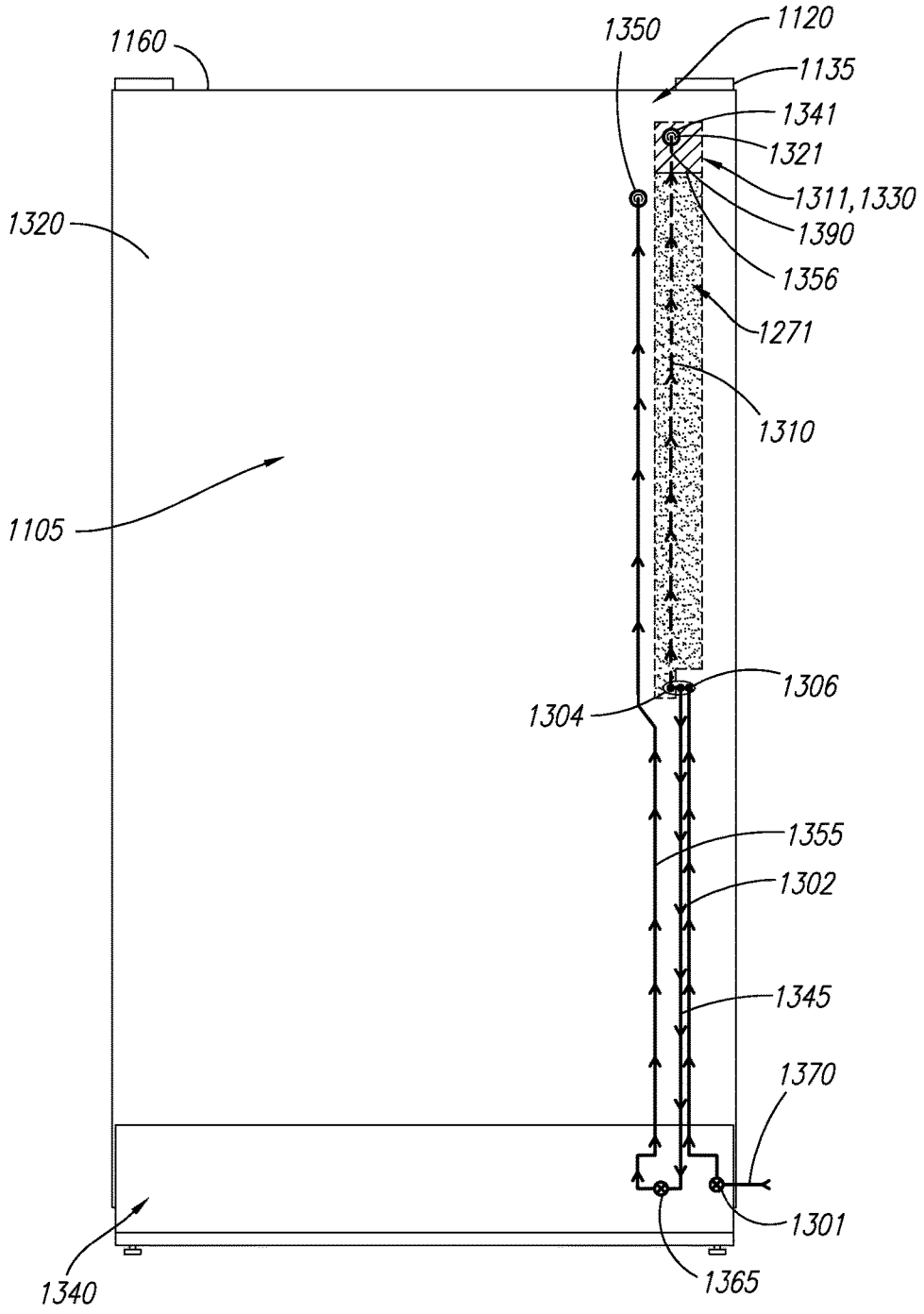
FIG. 13 is a schematic view illustrating an example of a rear wall of the cabinet of the refrigerator of FIG. 11.

As illustrated in FIGS. 13 and 14, the external liquid inlet valve 1301 may be provided at a bottom rear portion of the cabinet 1105. However, embodiments described herein are not limited thereto. For example, the external liquid inlet valve 1301 may be provided in any location at the rear portion of the cabinet 1105 that would be seen as accommodating with respect to the receipt of an external supply of liquid to one having ordinary skill in the art.

The external inlet liquid line 1302 may transport the external liquid provided from the external liquid source 1370 from the external liquid inlet valve 1301 to the liquid filter 1462. The external inlet liquid line 1302 may extend from the external liquid inlet valve 1301 through a cabinet liquid line hole 1406 provided in a substantially right middle portion of the cabinet 1105, an insulation liquid line hole 1403 in the insulation 1311, and a sealed cavity liquid line hole 1304 in a right bottom area 1214 of the rear wall 1271 of the chilled cavity 1240 to enter the chilled cavity 1240.

When in the chilled cavity 1240, the external inlet liquid line 1302 may further extend through a hole 1425 in the reservoir manifold 1260 to deliver the external liquid to the liquid filter 1462. After filtering the liquid, the liquid filter 1462 may outlet the filtered liquid to the filtered liquid line 1415 and into an inlet 1418 of the reservoir 1463 for chilling the filtered liquid therein until requested by a user. The reservoir 1463 may include an outlet 1480 from which chilled liquid from the reservoir 1463 is transferred into the reservoir outlet line 1435 upon user request.

The dispenser tubing may be defined a plurality of portions, including a chilled portion 1440 positioned within the chilled cavity 1240, an insulated portion, an ambient portion, and a door portion 1430 positioned within the liquid dispenser door 1125. A section of the chilled portion 1440 of the dispenser tubing may be additionally positioned within the reservoir manifold 1260. The reservoir 1463 may permit chilled liquid to pass out of the outlet 1480 and into the reservoir outlet line 1435 to be provided to the chilled portion 1440 of the dispenser tubing.

The chilled portion 1440 of the dispenser tubing may receive the chilled liquid from the reservoir outlet line 1435 through a two-way junction 1421 that splits the reservoir outlet line 1435 into the chilled portion 1440 of the dispenser tubing and the chilled icemaker line 1345. The chilled portion 1440 of the dispenser tubing may extend from the two-way junction 1421 through the hole 1425 in the reservoir manifold 1260 to the cavity liquid line hole 1304. The chilled icemaker line 1345 may extend from the two-way junction 1421, through the hole 1425 in the reservoir manifold 1260, through the cavity liquid line hole 1304, through the insulation liquid line hole 1403, and through the cabinet liquid line hole 1406 to the icemaker valve 1365 positioned adjacent to or within the rear area 1340 of the machine compartment.

While the chilled icemaker line 1345 is illustrated in FIGS. 13-15 as extending from the two-way junction 1421 between the reservoir outline line 1435 and the chilled portion 1440 of the dispenser tubing, embodiments disclosed herein are not limited thereto. For example, an alternative to the two-way junction 1421 may split the liquid provided by the filtered liquid line 1415 between an alternative to the chilled icemaker line 1345 and the filtered liquid line 1415 leading to the inlet 1418 of the reservoir 1463. In this example, the liquid being provided to the icemaker 1250 would bypass the reservoir 1463. In other words, the chilled icemaker line 1345 would extend directly from the two-way junction 1421 to the icemaker valve 1365, thereby bypassing the reservoir 1463. Further, in this example, the chilled portion 1440 of the dispenser tubing may extend from the reservoir 1463 through the hole 1425 in the reservoir manifold 1260 to the cavity liquid line hole 1304, thereby taking the place of the reservoir outlet line 1435.

The insulated portion of the dispenser tubing is positioned between the chilled cavity 1240 and the insulation 1311. The insulated portion of the dispenser tubing may be positioned tangent to the chilled cavity 1240. The insulated portion of the dispenser tubing may be secured to the chilled cavity 1240 by the insulation 1311.

The insulated portion of the dispenser tubing may extend from the cavity liquid line hole 1304 to a first hole 1350 in the insulation 1311 that is substantially adjacent to the rear wall 1320 of the cavity 1105. The insulated portion of the dispenser tubing may also extend from a second hole 1341 in the insulation 1311 positioned substantially adjacent to a top wall 1160 and the rear wall 1320 of the cabinet 1105 and a top corner 1451 of the chilled cavity 1240 to a third hole 1461 in the insulation 1311 substantially adjacent to the top wall 1160 of the cabinet 1105 and a front portion 1471 of the chilled cavity 1240.

The insulated portion of the dispenser tubing may be defined by a first insulated section 1310 and a second insulated section 1450. The first insulated section 1310 may be substantially positioned between the rear wall 1271 of the chilled cavity 1240 and the insulation 1311. The chilled portion 1440 of the dispenser tubing may be connected to the first insulated section 1310 through the cavity liquid line hole 1304. The second insulated section 1450 may be substantially positioned between a top wall 1460 of the chilled cavity 1240 and the insulation 1311.

When the first insulated section 1310 is at a first position 1485 between the insulation 1131 and the chilled cavity 1240 at which the first insulated section 1310 is separated from an area 1322 between the insulation 1311 and the rear wall 1320 of the cabinet 1105 by the first hole 1350 in the insulation 1311, the first insulated section 1310 may run through the first hole 1350 in the insulation 1131 to a first location 1356 at which the insulation 1311 interfaces with the area 1322 between the insulation 1311 and the rear wall 1320 of the cabinet 1105. The first insulation interface location 1356 is partially defined by the first hole 1350 in the insulation 1311.

The ambient portion of the dispenser tubing may be positioned within areas between the cabinet 1105 and the insulation 1311 or outside of the cabinet 1105. The ambient portion of the dispenser tubing may be defined by a first ambient section 1390 and a second ambient section 1411. The first ambient section 1390 may meet the first insulated section 1310 at the first insulation interface location 1356 and extend upward from the first insulation interface location 1356 between the rear wall 1320 of the cabinet 1105 and the insulation 1311 to meet the second insulated section 1450 at a second location 1321 at which the insulation 1311 interfaces with the area 1322 between the rear wall 1320 of the cabinet 1105 and the insulation 1311.

The second insulated section 1450 may extend through the second hole 1341 in the insulation 1311 to meet with the first ambient section 1390 at the second insulation interface location 1321. The insulation 1311 surrounding the second hole 1341 in the insulation 1311 may include an expanded polystyrene (EPS) foam block 1330 through which the second hole 1341 in the insulation 1311 is positioned. The EPS foam block 1330 may be positioned substantially adjacent to the top corner 1451 of the chilled cavity 1240. The second hole 1341 in the insulation 1311 may be positioned substantially adjacent to the top wall 1460, the top corner 1451, and the rear wall 1271 of the chilled cavity 1240.

The second insulated section 1450 may extend from the second insulation interface location 1321 through the second hole 1341 in the insulation 1311 between the insulation 1311 and the top wall 1460 of the chilled cavity 1240. When the second insulated section 1450 reaches a second position 1481 between the insulation 1311 and the top wall 1460 of the chilled cavity 1240 at which the second insulated section 1450 is separated from a top front area 1413 between the insulation 1311 and the top wall 1160 of the cabinet 1105 by the third hole 1461 in the insulation 1311, the second insulated section 1450 may run through the third hole 1461 in the insulation 1311 to a third location 1412 at which the insulation 1311 interfaces with the top front area 1413 between the insulation 1311 and the top wall 1160 of the cabinet 1105.

The second ambient section 1411 may extend from the second insulation interface location 1412 through the top wall 1160 of the cabinet 1105 and out of a cabinet-side portion 1135 of a hinge 1120 for the liquid dispenser door 1125. The cabinet-side portion 1135 of the hinge 1120 may be positioned on an outer surface of the top wall 1160 of the cabinet 1105. The second ambient section 1411 may then extend from the cabinet-side portion 1135 of the hinge 1220 through a door-side portion 1141 of the hinge 1220 positioned on the top wall 1150 of the liquid dispenser door 1125 to meet the door portion 1430 of the dispenser tubing at the top wall 1150 of the liquid dispenser door 1125. The door portion 1430 of the dispenser tubing may extend from the second ambient section 1411 through the liquid dispenser door 1125 until reaching the liquid dispenser 1110, thereby delivering the chilled liquid from the reservoir 1463. The second ambient section 1411 may include a liquid valve 1410 positioned between the second insulated section 1450 and the door portion 1430 of the dispenser tubing.

While the examples illustrated in FIGS. 1-15 are directed to refrigerators having icemakers 241 and 1250 respectively positioned within the freezer compartment and the fresh food compartment, embodiments disclosed herein are not limited thereto. Changes could be made to both the side-by-side refrigerator 100 and the bottom mount refrigerator 1100 to operationally support an in-door icemaker. For example, an in-door icemaker may be positioned above the water dispensers 110 and 1110 in the freezer door 120 and the liquid dispenser door 1125, respectively, in a way that is substantially similar to the icemaker arrangements illustrated in U.S. Pat. Nos. 7,076,967, 7,222,498, 7,228,701, 7,228,703, 7,392,665, 7,493,777, 7,654,105, 7,704,298, 8,516,844, 8,601,830, 8,671,711, 8,707,728, and 8,820,108 and U.S. Application Publication Nos. 2010/0287970, 2011/0113811, 2011/0113812, 2011/0113813, 2011/0146324, 2012/0011868, 2012/0318004, 2013/0167576, and 2014/0182324, all of which are incorporated by reference herein.

With respect to an example of the side-by-side refrigerator 100 illustrated in FIGS. 1-10, a supply of liquid may be provided along the same path as liquid is supplied to the liquid dispenser 110. As a result, certain elements of the side-by-side refrigerator 100 may be different or omitted. For example, since the icemaker would be positioned above the liquid dispenser 110, the supply path for the icemaker could be the same as the supply path for the liquid dispenser 110. The chilled icemaker line 341, the ambient icemaker line 342, and the icemaker valve 340 in the position presently illustrated with respect to FIGS. 1-10 could be optional. In addition, the two-way junction 421 to split the reservoir outlet line 419 into the chilled portion 407 of the dispenser tubing and the chilled icemaker line 341 could be optional, as the chilled portion 407 of the dispenser tubing and further elements of the dispenser tubing may run to a final location that is substantially adjacent to the liquid dispenser 110. However, the chilled icemaker line 341 could additionally be relocated to run from the two-way junction 421 through the dispenser tubing hole 412 and along the same path as the insulated portion 415 of the dispenser tubing to the front area 411 of the machine compartment.

The ambient icemaker line 342 could be relocated from the rear area 311 of the machine compartment to the front area 411 of the machine compartment to follow a path substantially similar to the ambient portion 425 of the dispenser tubing. The chilled icemaker line 341 could be relocated to receive liquid from the relocated ambient icemaker line 342 and substantially mirror a path of the door portion 845 of the dispenser tubing within the door 120 to provide liquid to the in-door icemaker. Further, since the ambient icemaker line 342 could be moved from to rear area 311 of the machine compartment to the front area 411 of the machine compartment, the two-way junction 421 could also be relocated from the chilled cavity 210 to the front area 411 of the machine compartment to split the liquid running in the ambient portion 425 of the dispenser tubing to the relocated ambient icemaker line 342. The icemaker valve 340 could additionally be relocated from the rear area 311 of the machine compartment to the front area 411 of the machine compartment and inserted at a position within the relocated ambient icemaker line 342 that would substantially mirror the position of the liquid dispenser valve 409. As a result, the two-way junction 421 could be omitted from the side-by-side refrigerator 100, as there would no longer be a reason for liquid to be transported to the icemaker 241 through the chilled icemaker line 341.

As a result, the chilled liquid stored in the reservoir 405 could be supplied from the reservoir 405 to the front area 411 of the machine compartment substantially through the chilled portion 407 of the dispenser tubing, the dispenser tubing hole 412 and the insulated portion 415 of the dispenser tubing of FIGS. 1-9, the insulated portion 1015 of the dispenser tubing positioned within the chilled cavity 210 in the conduit 1010 of FIG. 10, the position 485 between the insulation 435 and the chilled cavity 210 at which the insulated portion 415 of the dispenser tubing is separated from the front area 411 of the machine compartment, the hole 765 in the insulation 435, and the insulation interface location 755 to reach the ambient portion 425 of the dispenser tubing.

The relocation of the two-way junction 421, the chilled icemaker line 341, the ambient icemaker line 342, and the icemaker valve 340 as described above is only for illustrative purposes. In other words, one of ordinary skill in the art would understand that materials, hardware, dimensions, functionality, and usage of the relocated two-way junction 421, chilled icemaker line 341, ambient icemaker line 342, and icemaker valve 340 may differ from when the two-way junction 421, chilled icemaker line 341, ambient icemaker line 342, and icemaker valve 340 are applied in view of an icemaker being housed within the freezer cavity 230.

For example, while examples of the two-way junction 421, the chilled icemaker line 341, the ambient icemaker line 342, and the icemaker valve 340 are illustrated in FIGS. 1-10 as having a certain shape or orientation, the relocated two-way junction 421, chilled icemaker line 341, ambient icemaker line 342, and icemaker valve 340 may be representative of entirely different components, methods, capabilities, or structures known to one having ordinary skill in the art to complete the transfer of liquid from insulated portions 415 or 1015 of the dispenser tubing to the liquid dispenser 110 and the in-door icemaker.

Further, one of ordinary skill in the art would understand that the two-way junction 421, the chilled icemaker line 341, the ambient icemaker line 342, and the icemaker valve 340 illustrated in FIGS. 1-10 could be different or omitted from the side-by-side refrigerator 100 instead of being relocated therewithin. In this case, liquid could be transferred from the ambient portion 425 of the dispenser tubing.

In addition, one of ordinary skill in the art could apply various methods and components to transfer and control the supply of liquid to a liquid dispenser 110 and an in-door icemaker from the front area 411 of the machine compartment. For example, the liquid dispenser valve 409 and the relocated icemaker valve 340 could be positioned at any point within the front area 411 of the machine compartment. The liquid dispenser valve 409 and the relocated icemaker valve 340 could be positioned within an accessible portion of the door 120 that would be optimal for allowing maintenance of the valves 409 and 340. The in-door icemaker could resemble, be substantially similar to, or possess similar features of any of the in-door icemakers disclosed in the embodiments of the above-referenced patents and publications and any other in-door icemaker known to one of ordinary skill in the art.

With respect to an example of the bottom mount refrigerator 1100 illustrated in FIGS. 11-15, a supply of liquid may be provided along the same path as liquid is supplied to the liquid dispenser 1110. As a result, certain elements of the bottom mount refrigerator 1100 may be different or omitted. For example, since the icemaker would be positioned above the liquid dispenser 1110, the supply path for the icemaker could be substantially the same as the supply path for the liquid dispenser 1110. The two-way junction 1421 within the reservoir manifold 1260 and the chilled icemaker line 1345, the ambient icemaker line 1355, and the icemaker valve 1365 along the back wall 1320 of the cabinet 1105 may be optional. However, the chilled icemaker line 1345 could additionally be relocated and split into various portions to run from the two-way junction 1421 along the same pathway as the first insulated section 1310, the second insulated section 1450, and the door portion 1430 of the dispenser tubing.

The ambient icemaker line 1355 could be split in two and relocated from a position adjacent to the back wall 1320 of the cabinet 1105 to respective areas corresponding with the first ambient section 1390 and the second ambient section 1411 to follow a path substantially similar thereto. The chilled icemaker line 1345 could additionally be split in three and relocated to provide liquid from the two-way junction 1421 to the portion of the ambient icemaker line 1355 corresponding with the first ambient section 1390, from the portion of the ambient icemaker line 1355 corresponding with the first ambient section 1390 to the portion of the ambient icemaker line 1355 corresponding with the second ambient section 1411, and from the portion of the ambient icemaker line 1355 corresponding with the second ambient section 1411 to the in-door icemaker positioned adjacent to the liquid dispenser 1100, thereby substantially mirroring a path of the door portion 1430 of the dispenser tubing.

In another example, the two-way junction 1421 could be relocated from the reservoir manifold 1260 to an area adjacent to the top wall 1160 of the cabinet 1105, thereby forming a relocated portion of the ambient icemaker line 1355 corresponding with at least part of the second ambient section 1411 that extends to the in-door icemaker positioned adjacent to the liquid dispenser 1100 and substantially mirroring paths of at least a portion of the second ambient section 1411 and the door portion 1430 of the dispenser tubing. The icemaker valve 1365 could additionally be relocated from a position adjacent to or within the rear area 1340 of the machine compartment to a position adjacent to the liquid valve 1410 of the second ambient section 1450, thereby positioning the relocated icemaker valve 1365 within the portion of the ambient icemaker line 1355 corresponding with the second ambient section 1411 and substantially adjacent to the liquid valve 1410.

The chilled liquid stored in the reservoir 1463 could be supplied to the in-door icemaker substantially through the reservoir outlet line 1435, the chilled portion 1440 of the dispenser tubing, the hole 1425 in the reservoir manifold 1260, the cavity liquid line hole 1304, the first insulated section 1310, the first hole 1350 in the insulation 1311, the first insulation interface 1311, the first ambient section 1390, the second insulation interface 1321, the second hole 1341 in the insulation 1311, the second insulated section 1450, the third hole 1461 in the insulation 1311, the third insulation interface 1412, and the second ambient section 1411 to reach the door portion 1430 of the dispenser tubing. A relocated two-way junction 1411 could be provided such that the door portion 1430 of the dispenser tubing would be split.

The relocation of the two-way junction 1421, the chilled icemaker line 1345, the ambient icemaker line 1355, and the icemaker valve 1365 as described above is only for illustrative purposes. In other words, one of ordinary skill in the art would understand that materials, hardware, dimensions, functionality, and usage of the relocated two-way junction 1421, chilled icemaker line 1345, ambient icemaker line 1355, and icemaker valve 1365 may differ from when the two-way junction 1421, chilled icemaker line 1345, ambient icemaker line 1355, and icemaker valve 1365 are applied in view of an icemaker being housed within the chilled cavity 1240.

For example, while examples of the two-way junction 1421, chilled icemaker line 1345, ambient icemaker line 1355, and icemaker valve 1365 are illustrated in FIGS. 11-15 as having a certain shape or orientation, the relocated two-way junction 1421, chilled icemaker line 1345, ambient icemaker line 1355, and icemaker valve 1365 may be representative of entirely different components, methods, capabilities, or structures known to one having ordinary skill in the art to complete the transfer of liquid from the first insulated section 1311 to the second insulated section 1450 and the second insulated section 1450 to the liquid dispenser 1110 and the in-door icemaker.

Further, one of ordinary skill in the art would understand that the two-way junction 1421, the chilled icemaker line 1345, the ambient icemaker line 1355, and the icemaker valve 1365 illustrated in FIGS. 11-15 could be different or omitted from the bottom-mount refrigerator 1100 instead of being relocated therewithin. In this case, liquid could be transferred to the liquid dispenser 1100 along a dedicated icemaker line that substantially mirrors the positioning and path of the dispenser tubing.

In addition, one of ordinary skill in the art could apply various methods and components to transfer and control the supply of liquid to a liquid dispenser 1110 and an in-door icemaker from the top wall 1160 of the cabinet 1105. For example, the liquid dispenser valve 1410 and the relocated icemaker valve 1365 could be positioned at any point above the top wall 1160 of the cabinet 1105. The liquid dispenser valve 1410 and the relocated icemaker valve 1365 could be positioned within an accessible portion of the liquid dispenser door 1125 that would be optimal for allowing maintenance of the valves 1410 and 1365. The in-door icemaker could resemble, be substantially similar to, or possess similar features of any of the in-door icemakers disclosed in the embodiments of the above-referenced patents and publications and any other in-door icemaker known to one of ordinary skill in the art.

A number of examples have been described above. Nevertheless, it will be understood that various modifications may be made. For example, suitable results may be achieved if the described elements are combined in a different manner and/or replaced or supplemented by other elements or their equivalents. Accordingly, other implementations are within the scope of the following claims.

What is claimed is:

1. A refrigerator, comprising:

a cabinet comprising a chilled cavity, cabinet insulation surrounding the chilled cavity, and a door by which the chilled cavity is opened and closed, the chilled cavity comprising a reservoir configured to store liquid provided thereto from an external liquid source to be chilled in the chilled cavity; and a drinkable liquid dispensing system comprising:

a dispenser tubing that includes first and second insulated portions positioned between the chilled cavity and the cabinet insulation, and an ambient portion positioned outside of the cabinet insulation, wherein the ambient portion of the dispenser tubing comprises a first ambient section that is disposed between the first and second insulated portions; and a liquid dispenser positioned on the door, wherein the dispenser tubing is configured to transport the chilled liquid from the reservoir to the liquid dispenser, and the liquid dispenser is configured to dispense the chilled liquid transported thereto by the dispenser tubing upon request, wherein the dispenser tubing passes through a tubing hole positioned on a rear wall of the chilled cavity, and thereafter the first insulated portion of the dispenser tubing extends to a first location, positioned vertically above the tubing hole, where the first insulated portion and the first ambient section interface, wherein the first insulated portion is substantially positioned between the rear wall of the chilled cavity and the cabinet insulation, and the second insulated portion is substantially positioned between a top wall of the chilled cavity and the cabinet insulation, wherein the ambient portion of the dispenser tubing further comprises a second ambient section that extends from the second insulated portion, wherein the first insulated portion extends upward from the tube hole between the rear wall of the chilled cavity and the cabinet insulation and exits the cabinet insulation to meet the first ambient section between the cabinet insulation and a rear wall of the cabinet, and wherein the first ambient section extends upward from the first insulated portion between the cabinet insulation and the rear wall of the cabinet and meets the second insulated portion at a second location at which the cabinet insulation interfaces with an area between a rear wall of the cabinet and the cabinet insulation, the second insulated portion extending through a first hole in the cabinet insulation to meet with the first ambient section at the second insulation interface location.

2. The refrigerator of claim 1, wherein the first and second insulated portions of the dispenser tubing are positioned tangent to the chilled cavity.

3. The refrigerator of claim 1, wherein the first and second insulated portions of the dispenser tubing are secured to the chilled cavity by the cabinet insulation.

4. The refrigerator of claim 1, wherein the reservoir comprises an outlet configured to provide the chilled liquid to a chilled portion of the dispenser tubing positioned in the chilled cavity, the chilled portion of the dispenser tubing being connected to the first insulated portion of the dispenser tubing through the tubing hole.

5. The refrigerator of claim 1, wherein the second insulated portion extends through a second hole in the insulation and meets the second ambient section at a third location at which the cabinet insulation interfaces with a top wall of the cabinet, the second insulated portion extending through a second hole in the cabinet insulation to reach the third insulation interface location, wherein the second ambient section extends from the second insulated portion from the third insulation interface location through the top wall of the cabinet and out of a cabinet-side portion of a hinge for the door, the cabinet-side portion of the hinge being positioned on the top wall of the cabinet, wherein the second ambient section extends from the cabinet-side portion of the hinge through a door-side portion of the hinge positioned at a top wall of the door to meet a door portion of the dispenser tubing that extends through the door to the liquid dispenser, and wherein a liquid valve is positioned in the second ambient section of the dispenser tubing.

6. A refrigerator, comprising:

a cabinet comprising a chilled cavity, cabinet insulation surrounding the chilled cavity, and a door by which the chilled cavity is opened and closed, the chilled cavity comprising a reservoir configured to store liquid provided thereto from an external liquid source to be chilled in the chilled cavity; and a drinkable liquid dispensing system comprising:

a dispenser tubing that includes first and second insulated portions positioned between the chilled cavity and the cabinet insulation, and an ambient portion positioned outside of the cabinet insulation, wherein the ambient portion of the dispenser tubing comprises a first ambient section that is disposed between the first and second insulated portions; and a liquid dispenser positioned on the door, wherein the dispenser tubing is configured to transport the chilled liquid from the reservoir to the liquid dispenser, and the liquid dispenser is configured to dispense the chilled liquid transported thereto by the dispenser tubing upon request, wherein the dispenser tubing passes through a tubing hole positioned on a rear wall of the chilled cavity, and thereafter the first insulated portion of the dispenser tubing extends to a first location, positioned vertically above the tubing hole, where the first insulated portion and the first ambient section interface, and wherein the first ambient portion of the dispenser tubing is shorter in length than at least one of the first and second insulated portions of the dispenser tubing.

* * * * *